US006517446B2

(12) United States Patent
Waddell

(10) Patent No.: US 6,517,446 B2
(45) Date of Patent: Feb. 11, 2003

(54) APPARATUS AND PRODUCT FOR IMPROVING A GOLFER'S SWING

(76) Inventor: Robert T. Waddell, 834 Coronado, Apt. 1, Long Beach, CA (US) 90804

( * ) Notice: Subject to any disclaimer, the term of this patent is extended or adjusted under 35 U.S.C. 154(b) by 0 days.

(21) Appl. No.: 09/844,348

(22) Filed: Apr. 27, 2001

(65) Prior Publication Data

US 2002/0183131 A1 Dec. 5, 2002

(51) Int. Cl.[7] ..... A63B 69/36
(52) U.S. Cl. ..... 473/277
(58) Field of Search ..... 473/277, 207, 473/215, 266; 602/16, 23

(56) References Cited

U.S. PATENT DOCUMENTS

| | | | | |
|---|---|---|---|---|
| 2,654,365 A | * | 10/1953 | Whitaker | 602/16 |
| 4,602,627 A | * | 7/1986 | Vito et al. | 602/23 |
| 4,706,957 A | | 11/1987 | Jackson | |
| 4,969,452 A | * | 11/1990 | Petrofsky et al. | 602/16 |
| 5,016,885 A | | 5/1991 | Quigley | |
| 5,062,642 A | | 11/1991 | Berry et al. | |
| 5,188,365 A | | 2/1993 | Picard | |
| 5,303,927 A | | 4/1994 | Perry et al. | |
| 5,443,267 A | | 8/1995 | Thorson | |
| D372,064 S | | 7/1996 | Del Barrio | |
| 5,839,968 A | | 11/1998 | Latella | |
| 6,129,368 A | | 10/2000 | Davis | |

FOREIGN PATENT DOCUMENTS

| | | |
|---|---|---|
| WO | WO 98/53888 | 12/1998 |

* cited by examiner

*Primary Examiner*—Paul T. Sewell
*Assistant Examiner*—M. Chambers
(74) *Attorney, Agent, or Firm*—James G. O'Neill

(57) ABSTRACT

An improved training aid and method for teaching and improving the swing of a golfer. The device includes a rigid upper torso support, a rigid thigh support, and a rigid calf support that are strapped on a selected side of the body of the golfer. A rigid stabilizer is secured between the rigid upper torso and the rigid thigh support. The method includes the use of the training aid strapped on one side of the body of the golfer and to aid the golfer in turning and maintaining balance over a ball during a golf swing, while preventing a reverse C and unwanted movement toward or away from the ball, or the direction it is desired that the ball travel.

8 Claims, 6 Drawing Sheets

APPARATUS AND PRODUCT FOR IMPROVING A GOLFER'S SWING

BACKGROUND OF THE INVENTION

1. Field of the Invention

This invention relates generally to teaching aids, and more particularly, to an aid for improving the mechanics of a golfer's swing.

2. Description of Related Art

As is well known to golfers, the holding of a golf club, body alignment and stroke, or swing, together with clubface alignment when hitting a golf ball are important in playing a good game of golf. In this connection, numerous devices and methods have been adopted, and many patents obtained on devices and methods for improving golf swings. Examples of such known devices and methods are set forth in the following U.S. and international patents:

Des. 372,064 to del Barrio; 5,303,927 to Perry et al.;

4,706,957 to Jackson; 5,443,267 to Thorson;

5,016,885 to Quigley; 5,839,968 to Latella;

5,062,642 to Berry et al.; 6,129,638 to Davis;

5,188,365 to Picard; WO 98/53888 to Priestley

While the known devices aid in allowing a golfer to improve their swing, the known devices and methods do not adequately work for all golfers, nor do they provide the correct, continuous, repetitive motion necessary to create "muscle memory" required for a consistent golf swing.

Therefore, there exists a need in the art for an improved and simplified device and method which permits a golfer to improve their golf swing, by making the golfer turn properly during a swing, and by teaching the proper use of a golf club to prevent a "reverse C," swaying toward the ball and improper movements of hips and legs.

SUMMARY OF THE INVENTION

Accordingly, it is a general object of the present invention to provide an improved training device for aiding a golfer's swing. It is a particular object of the present invention to provide an improved harness device to be worn by a golfer to properly teach good golf swing technique. It is another particular object of the present invention to provide an improved harness device to be worn by a golfer during practice to make the golfer turn properly during a swing. It is yet another particular object of the present invention to provide an improved training aid for use in teaching a golfer to keep balanced over a golf ball during a swing. It is yet a further particular object of the present invention to provide an improved process for teaching a golfer to identify and avoid improper turning movement during a golf swing. And, it is a still further particular object of the present invention to provide an improved device to be worn by a golfer to aid in perfecting the consistency of the golfer's swing.

These and other objects of the present invention are achieved by providing a training aid or harness to be worn by a golfer. The training aid includes means for holding the training aid around the calf, thigh and upper torso of the golfer and preventing unwanted movement thereof. The training aid is secured on the golfer's body on the side closest to the ball and/or intended direction of the desired flight of a golf ball. The training aid includes a rigid stabilizer that is positioned down the side of the golfer's body and secured to holding means on the golfer's calf and upper torso. The training aid of the present invention stops the golfer from "swaying" toward the ball to be struck during a swing, and helps the golfer in accomplishing a proper turn during the swing to produce straighter, higher, longer and more consistent and accurate golf shots.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawing, in which:

DETAILED DESCRIPTION OF THE PREFERRED EMBODIMENT

The following description is provided to enable any person skilled in the art to make and use the invention, and sets forth the best modes contemplated by the inventor of carrying out his invention. Various modifications, however, will remain readily apparent to those skilled in the art, since the generic principles of the present invention have been defined herein, specifically to provide for an improved device and method for teaching the fundamentals of a proper golf swing.

Good muscle memory creates consistency in swinging a golf club and properly hitting a golf ball. Therefore, the primary goal in teaching good swinging technique is to move properly and consistently. To use the training aid and practice the swinging method disclosed herein, it is well known that swaying and other unwanted movements during a golf swing will destroy such consistency. The present invention helps to teach the proper movements and prevent unwanted movements and to teach proper swing technique and consistency. By using the novel training aid and process of the present invention a golfer is more effectively taught how to swing a golf club and strike a golf ball.

Figure 1:
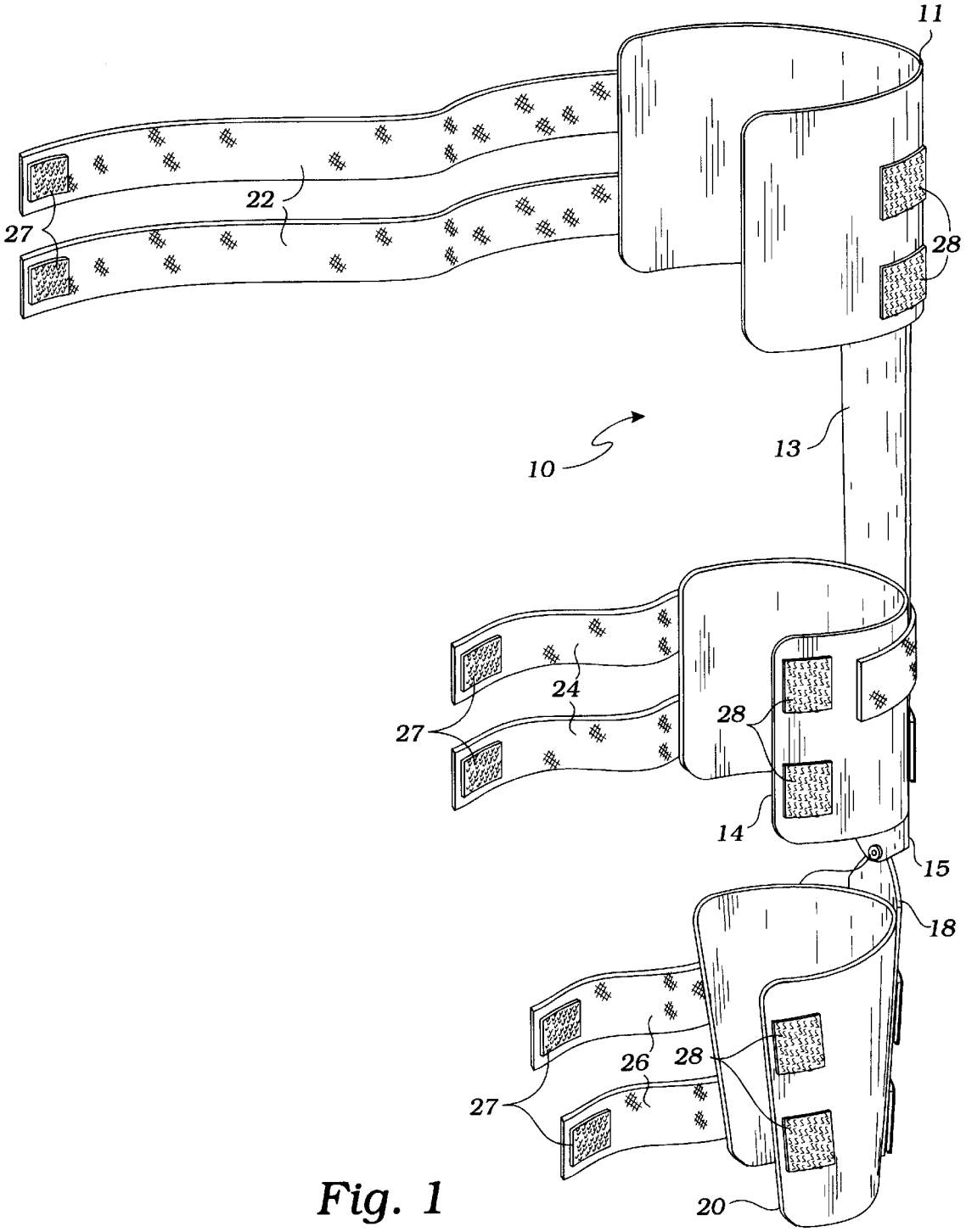
FIG. 1 is a perspective view of a preferred embodiment of the training aid of the present invention, with straps of securing portions thereof in the open position.
Figure 2:
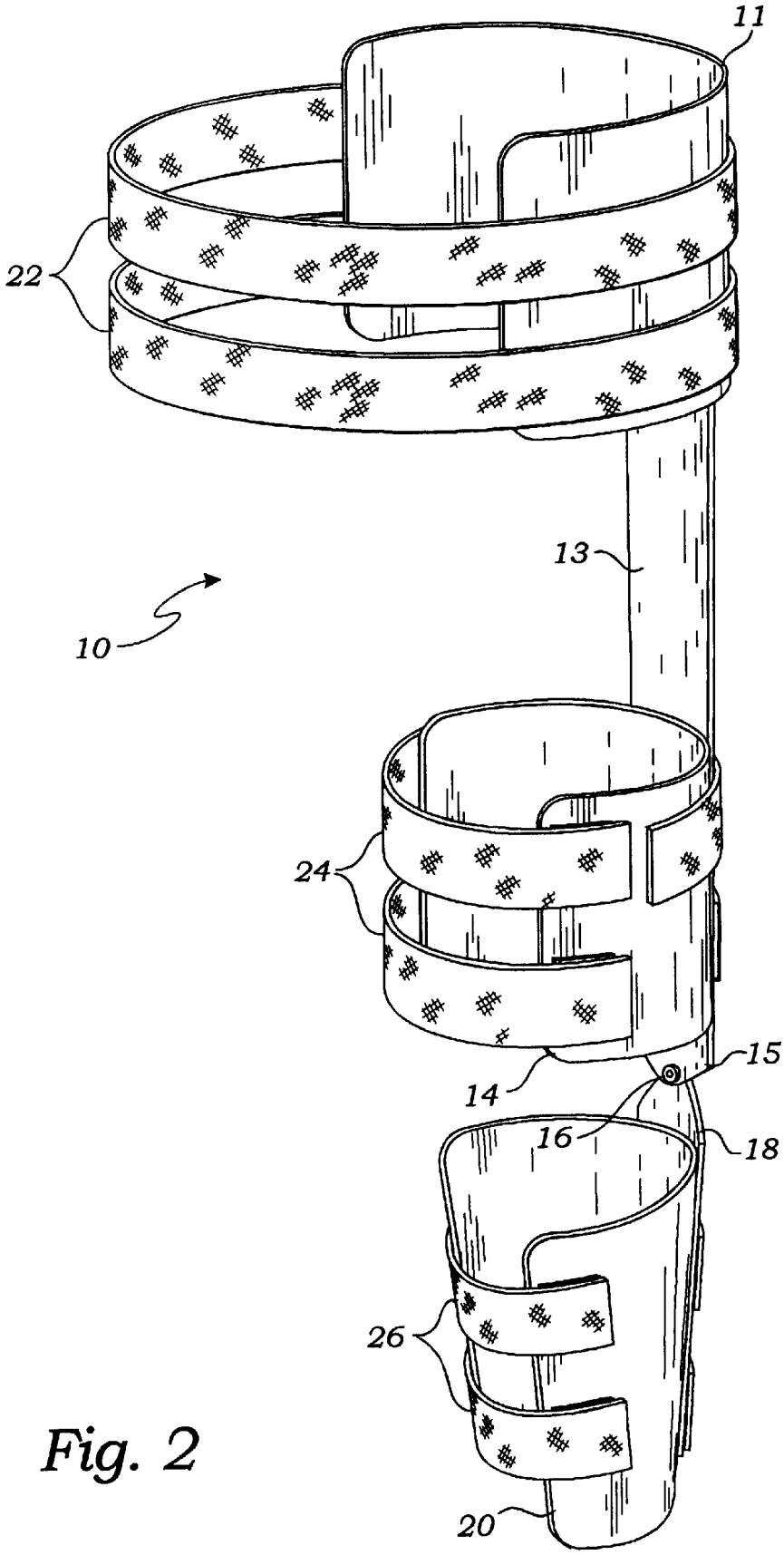
FIG. 2 is a further perspective view of the training aid of FIG. 1, with the securing straps in the closed position.
Figure 3:
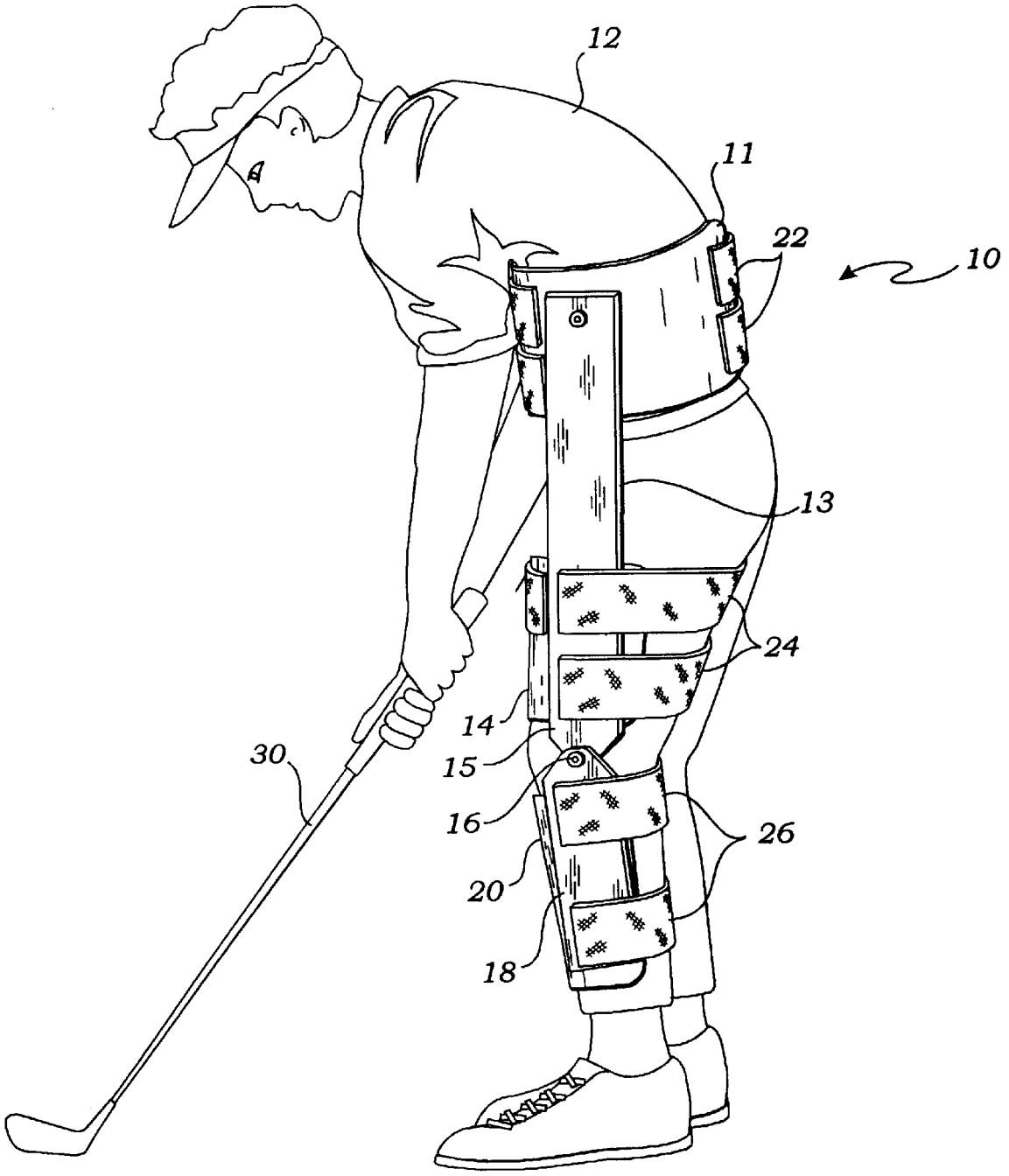
FIG. 3 is a perspective view of a golfer with the preferred embodiment of the present invention shown in FIG. 1, secured in place on a golfer's upper torso, thigh and calf.

The training aid of the present invention is preferably a harness-type device 10, as shown in FIGS. 1–3 of the drawings. A golfer 12 will wear the device 10 on the golfer's body, as shown in FIGS. 3–5 and 8–10 on the side of the golfer that is closest to a ball to be struck and/or the intended direction of a ball's desired flight.

Referring to FIGS. 1–3, the preferred embodiment of the training aid or device 10, will now be described. The device includes a rigid upper or torso portion 11, a flat rigid stabilizer 13, secured to the rigid torso portion and a rigid thigh holder or support 14. A lower end 15 of the stabilizer includes a hinge or other joint 16, attached to a rigid rib 18 secured to rigid calf holder or support 20.

The rigid torso portion 11 includes one or more securing straps 22, while the rigid thigh holder 14 and rigid calf support 20 include shorter securing straps 24, 26. The straps 22 secure the rigid torso portion 11 to the selected side of the golfer 12 (see FIG. 3), by being wrapped around the waist and upper torso of the golfer and secured by holding means 27 at the ends of straps 22 to holding elements or means 28, held on the rigid torso portion 11. The holding elements or means may take any desired or known form, such as hook and loop securing elements. Similar securing or holding means 27 are secured to the ends of straps 24 and 26 and holding elements 28 are secured to the rigid thigh support 14 and the rigid calf support 20, to enable these supports to be secured around a thigh and calf of a golfer (see FIG. 3).

The rigid torso portion 11, the rigid thigh holder 14 and rigid calf support 20 are preferably made from metal or plastic, may include padding on the inside surface thereof to be more comfortable and are curved to properly fit around and hold the upper body or torso, thigh and leg of the golfer 12 in the desired positions.

Figure 5:
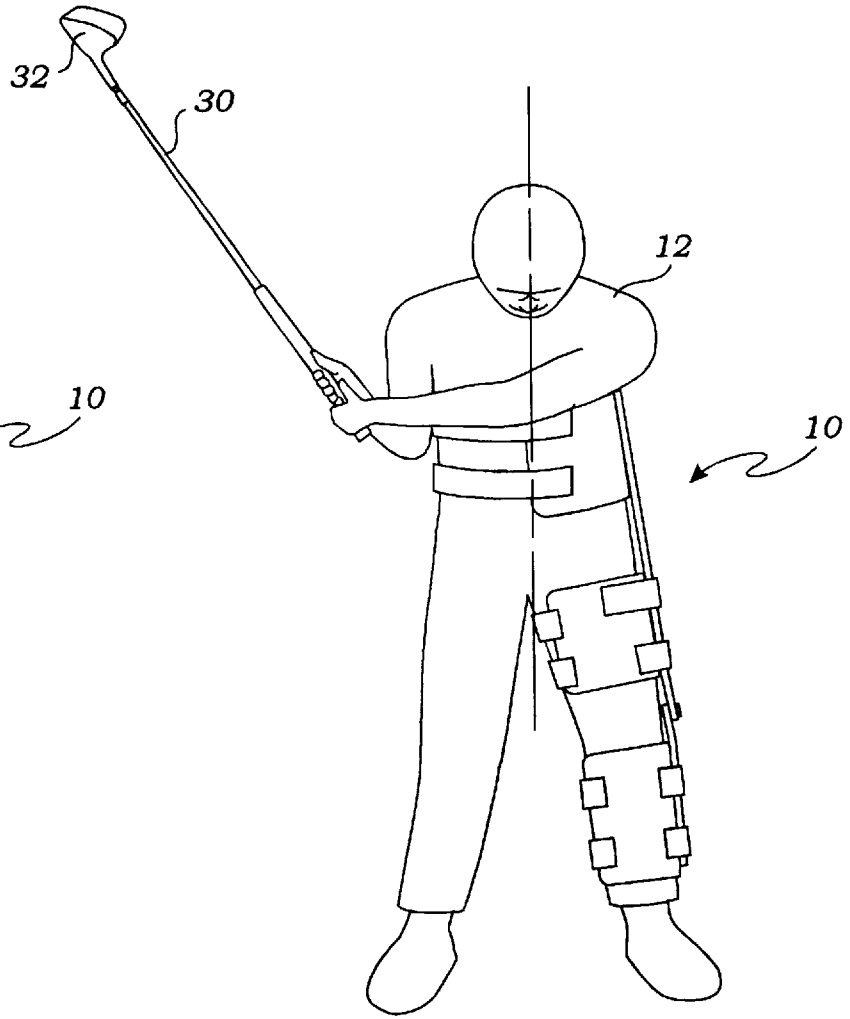
FIGS. 4 and 5 are diagramatic views showing how a golfer would address a ball and swing a club while wearing the training aid of the present invention.
Figure 4:
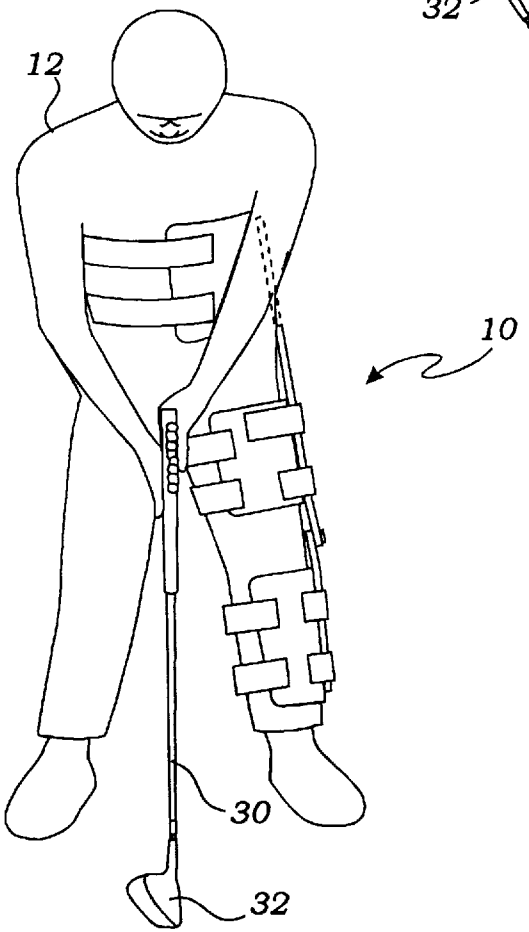

As shown in FIGS. 3–5, when a golfer 12 has the training aid 10 secured to the upper torso, calf and thigh and holds and swings a golf club 30, the training aid 10 will restrain the golfer's upper torso, calf and thigh in their proper positions throughout a predetermined range of movement of the golf club. That is, the training aid 10 will train the golfer 12 to properly swing back from a ball (FIGS. 3 & 4) to the raised club position (FIG. 5) and to then swing downwardly in a correct turn, around the golfer's spine, back to the golf ball impact area with a face of club head 32 properly aligned to meet the ball. The training aid 10 prevents the golfer 12 from swaying or lunging toward the ball or intended direction of the ball's flight, and keeps the golfer's legs, particularly the leg having the stabilizer 13, thigh holder 14 and calf holder 20 strapped thereto, from improperly moving.

Figure 7:
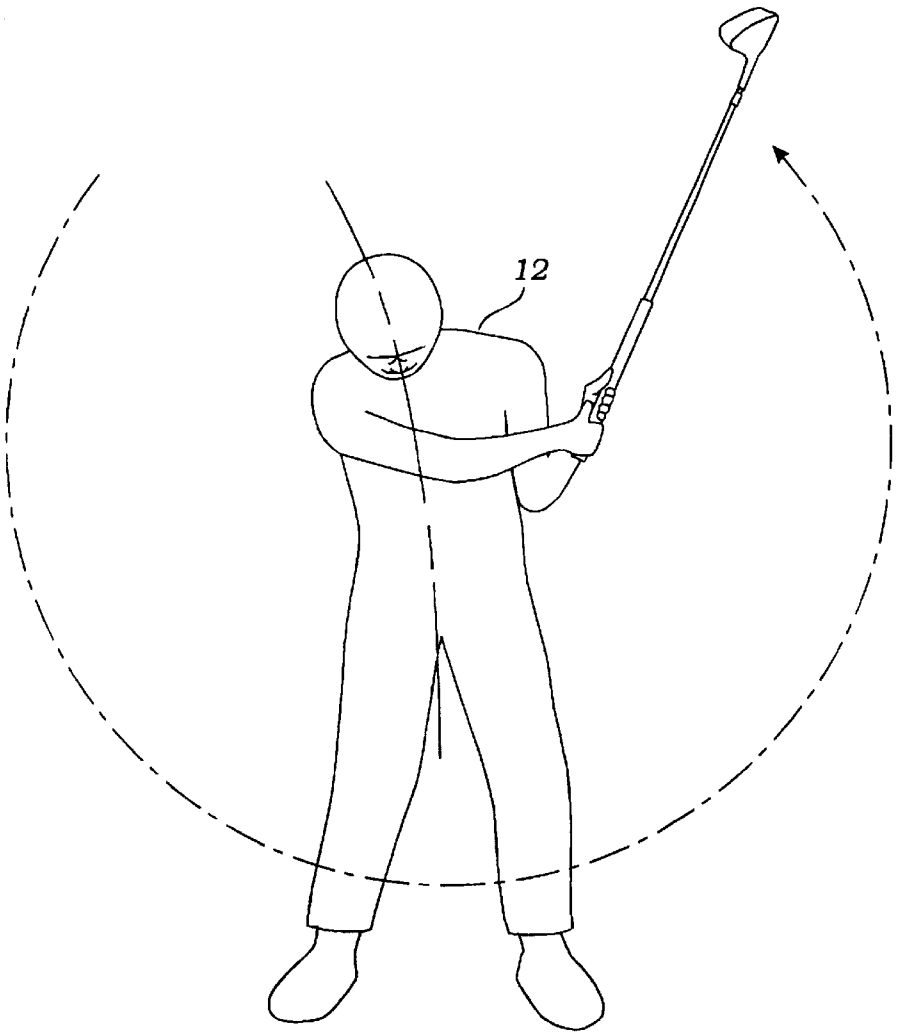
FIGS. 6 and 7 are further diagramatic views of a golfer not wearing a training aid of the present invention incorrectly swinging and swaying while swinging a club to form a "reverse C" with his body.
Figure 6:
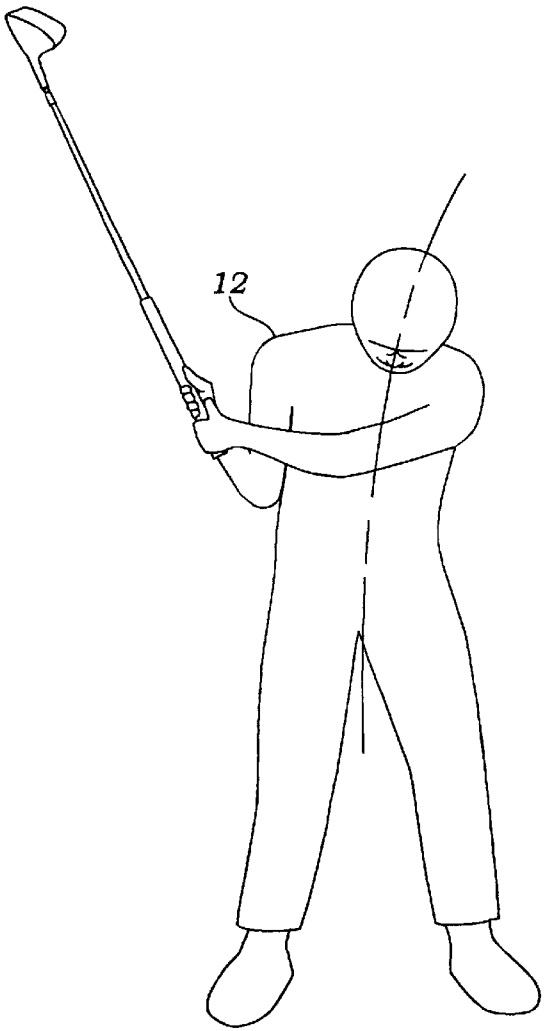
Figure 10:
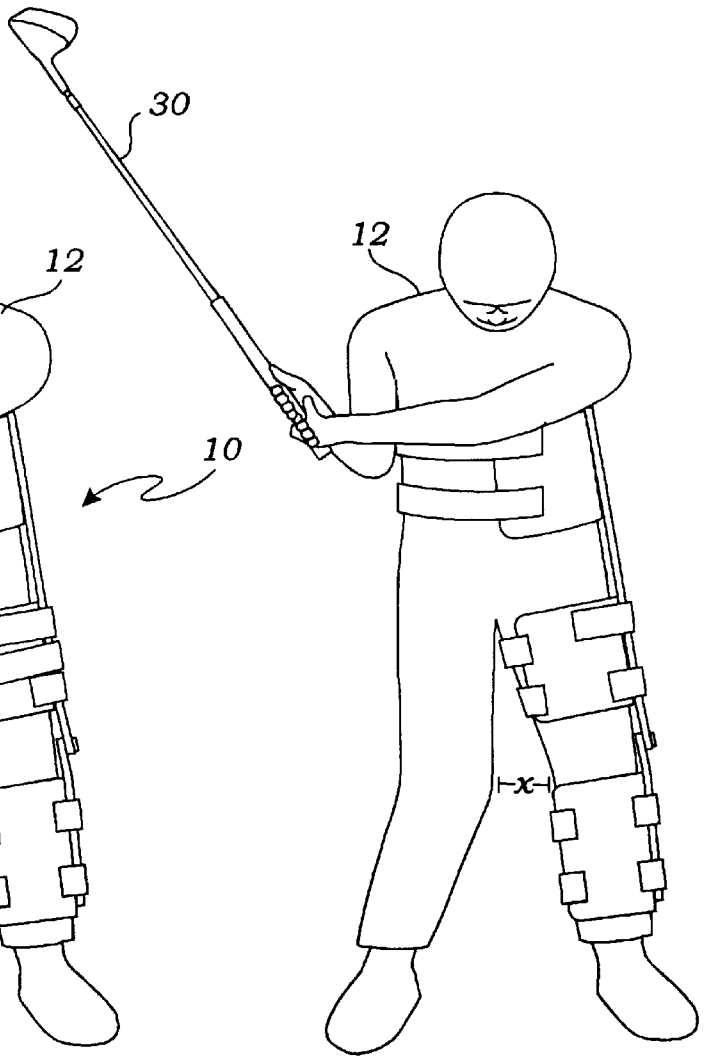
FIG. 10 is a diagramatic view of a golfer wearing the preferred embodiment of the present invention, during a swing, and showing unwanted movement of one of the golfer's legs toward the restrained leg.

It should be pointed out that the torso support or holder portion 11 as well as the other supports 14 and 20 are sufficiently rigid and of sufficient size to prevent the golfer 12 from bending his torso into a "reverse C" (see FIGS. 6 and 7), or bending or moving the leg to which the supports 14 and 20 are secured. That is, as shown in FIG. 5, the golfer's upper body is held straight because of the rigidity and size of the torso holder 11, and the leg to which the thigh support 14 and calf support 20 are secured, except for the possible bending of the knee, is held straight and against unwanted movement with the aid of the stiffness of the rigid stabilizer 13. The training aid 10 helps the golfer 12 to make correct turns and/or prevents unwanted bending of the upper body and movements of the hips and legs, while helping the golfer to keep his balance over the ball.

The hinge or joint 16 between the lower end of the rigid stabilizer 13 and rib 18 allows the golfer 12 to flex his knee, and/or walk when wearing the device 10.

The training aid 10 and method of the present invention improves the mechanics of the player's golf stroke or swing, while improving a golfer's ability to hit the ball with the proper force while striking the sweet spot of the club head 32 of club 30. The golfer 12 can practice golf swings while wearing the training aid 10 to thereby learn proper turning and the avoidance of unnecessary movements. In this manner, optimum golf head alignment with the ball is obtained and the proper and maximum forward force is applied to the ball. By using this process and training aid, players improve the mechanics of their swing and timing of their body by making them more consistent, resulting in proper muscle memory. This method and training aid produces straighter, higher, longer and more accurate ball movement after impact, thereby improving the golfer's game. Using the training aid 10 and method of the present invention, the player's sensitivity to improper turns or body movements during swinging is improved, thereby improving the mechanics of the player's golf swing.

Figure 9:
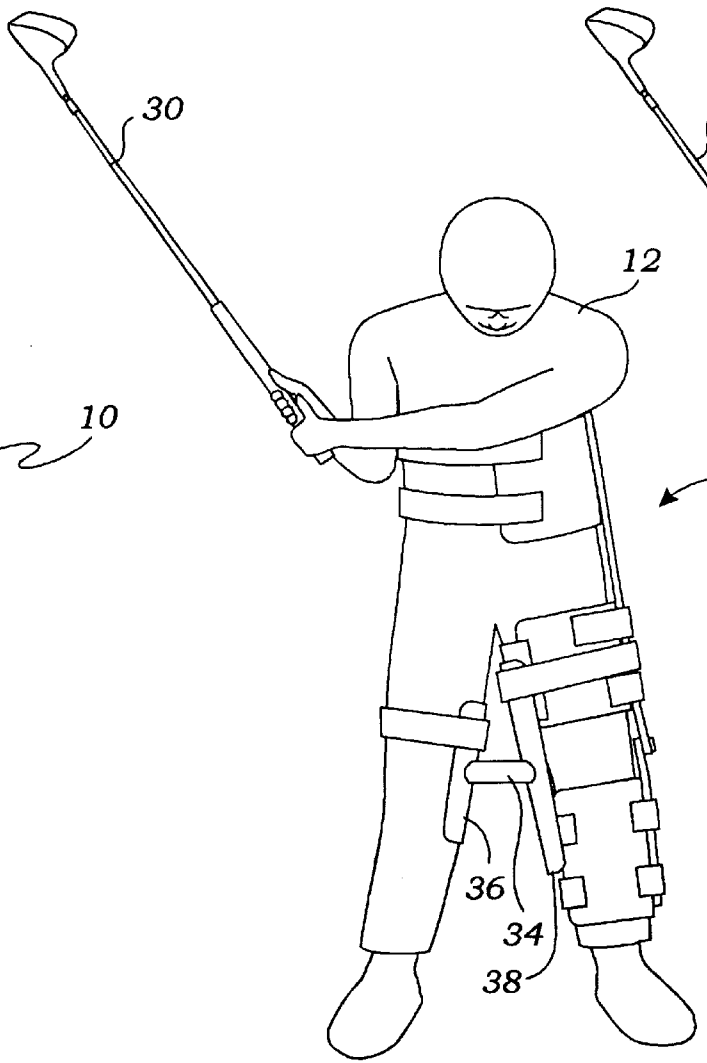
FIGS. 8 and 9 are further diagramatic views of a golfer using a second embodiment of the training aid of the present invention having a support between the legs of the golfer, illustrating a proper swing by the golfer.
Figure 8:
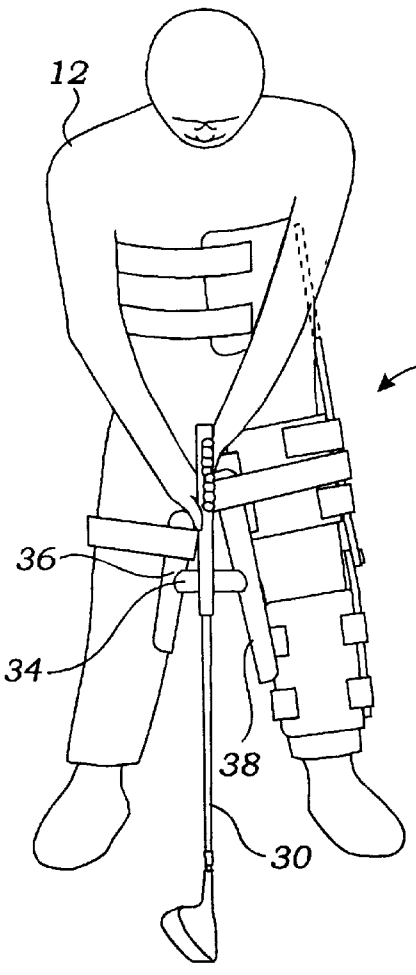

As shown in FIGS. 8 and 9, the training aid 10 may include a brace or spacer 34, held or strapped thereto to prevent the golfer 12 from moving his legs together (see FIG. 10), or to maintain the golfer's legs a predetermined distance apart. This brace or spacer 34 may include enlarged, shaped ends 36, 38 to conform to the golfer's legs and may be strapped or otherwise held in position on both of the golfer's legs.

It, therefore, can be seen that the training aid and method of the present invention provides a golfer with a novel and unique way of improving their swing. The training aid and method of the present invention prevent sway during a golf club swing and help the golfer keep balanced over the ball, while aiding the golfer in correctly turning during the downward stroke toward the ball.

Those skilled in the art will appreciate that there are adaptations and modifications of the just-described preferred embodiments that can be configured without departing from the scope and spirit of the invention. Therefore, it is to be understood, that within the scope of the intended claims, the invention may be practiced other than is specifically described herein.

What is claimed is:

1. A training aid for aiding a golfer in improving a golf swing, comprising:

a U-shaped, rigid torso-conforming portion having a plurality of straps for securing the U-shaped, rigid torso-conforming portion around a waist and upper torso of the golfer on a side closest to a ball to be struck; the U-shaped, rigid torso-conforming portion being sized and dimensioned so as to only grip and support the side of a golfer against which the U-shaped, rigid torso-conforming portion is secured;

a rigid stabilizer having two ends;

a first of the two ends secured to the U-shaped, rigid torso-conforming portion;

a U-shaped, rigid thigh-conforming support having a plurality of straps for securing around a portion of a thigh of a golfer on a side of the portion of thigh closest to a ball to be struck;

a second of the two ends secured to the U-shaped, rigid thigh-conforming support;

a U-shaped, rigid calf-conforming support having a plurality of straps for securing around a portion of a calf of a golfer on a side of the portion of the thigh closest to a ball to be struck;

a joint formed between the second of the two ends and a rigid rib secured to the U-shaped, rigid calf-conforming support to allow relative movement between the U-shaped, rigid thigh-conforming support and the U-shaped, rigid calf-conforming support around the joint; and a brace for holding between a golfer's legs and cooperating with the training aid to maintain a golfer's legs a predetermined distance apart.

2. The training aid of claim 1 wherein the brace has enlarged, shaped ends for conforming to a golfer's legs.

3. The training aid of claim 2, further including holding means for holding the enlarged, shaped ends of the brace in position between a golfer's legs.

4. A training aid for aiding a golfer in improving a golf swing, comprising:

a U-shaped, rigid torso-conforming portion sized and dimensioned to fit on one side of a torso of a golfer;

a pair of straps secured to open ends of the U-shaped, rigid torso-conforming portion for securing the U-shaped, rigid torso-conforming portion to a side of a waist and upper torso of a golfer on a side of a golfer closest to a ball to be hit;

a rigid stabilizer having two ends;

a first of the two ends secured to the U-shaped, rigid torso-conforming portion on the side of a golfer closest to a ball to be hit;

a U-shaped, rigid thigh-conforming support sized and dimensioned to fit on one side of a golfer's thigh and having a pair of straps for securing the U-shaped, rigid thigh-conforming support to one side of a golfer's thigh on a side of a golfer closest to a ball to be hit;

a second of the two ends secured to the U-shaped, rigid thigh conforming support on the side of a golfer closest to a ball to be hit;

a U-shaped, rigid calf-conforming support sized and dimensioned to fit on one side of a golfer's calf and having a pair of straps for securing the U-shaped, rigid calf-conforming support to one side of a golfer's calf on a side of the golfer closest to a ball to be hit;

a joint formed between the second of the two ends and a rigid rib secured to the U-shaped, rigid calf-conforming support to allow relative movement between the U-shaped, rigid thigh-conforming support and the U-shaped, rigid calf-conforming support around the joint; and a brace for holding between a golfer's legs and cooperating with the training aid to maintain a golfer's legs a predetermined distance apart.

5. The training aid of claim 4, wherein the brace has enlarged, shaped ends for conforming to a golfer's legs.

6. The training aid of claim 5, further including holding means for holding the enlarged, shaped ends of the brace in position between a golfer's legs.

7. A training aid for aiding a golfer in improving a golf swing, comprising:

a U-shaped, rigid torso-conforming portion sized and dimensioned to fit on one side of a torso of a golfer;

a pair of straps secured to open ends of the U-shaped, rigid torso-conforming portion for securing the U-shaped, rigid torso-conforming portion to a side of a waist and upper torso of a golfer on a side of a golfer closest to a ball to be hit;

a rigid stabilizer having two ends;

a first of the two ends secured to the U-shaped, rigid torso-conforming portion on the side of a golfer closest to a ball to be hit;

a U-shaped, rigid thigh-conforming support sized and dimensioned to fit on one side of a golfer's thigh and having a pair of straps for securing the U-shaped, rigid thigh-conforming support to one side of a golfer's thigh on a side of a golfer closest to a ball to be hit;

a second of the two ends secured to the U-shaped, rigid thigh conforming support on the side of a golfer closest to a ball to be hit;

a U-shaped, rigid calf-conforming support sized and dimensioned to fit on one side of a golfer's calf and having a pair of straps for securing the U-shaped, rigid calf-conforming support to one side of a golfer's calf on a side of the golfer closest to a ball to be hit;

a joint formed between the second of the two ends and a rigid rib secured to the U-shaped, rigid calf-conforming support to allow relative movement between the U-shaped, rigid thigh-conforming support and the U-shaped, rigid calf-conforming support around the joint; and a brace to be held between a golfer's legs to maintain a golfer's legs a predetermined distance apart.

8. The training aid of claim 7 wherein the brace has enlarged, leg-conforming shaped ends that are held to a golfer's legs by holding means wrapped around a golfer's legs.

* * * * *